US007722445B2

(12) United States Patent
Kraenzler et al.

(10) Patent No.: US 7,722,445 B2
(45) **Date of Patent: *May 25, 2010**

(54) INSERTION TOOL FOR AN ANGLE GRINDER

(75) Inventors: Ernst Kraenzler, Leinfelden-Echterdingen (DE); Peter Stierle, Waldenbuch (DE); Albrecht Hofmann, Steinbronn (DE); Juergen Wiker, Leinfelden-Echterdingen (DE); Harald Krondorfer, Mt. Prospect, IL (US); Joachim Schadow, Dettenhausen (DE); Sinisa Andrasic, Schoenaich (DE); Thomas Schomisch, Filderstadt (DE); Christof Hoelzl, Vomp (AT); Johann Huber, Kramsach (AT)

(73) Assignee: Robert Bosch GmbH, Stuttgart (DE)

( * ) Notice: Subject to any disclaimer, the term of this patent is extended or adjusted under 35 U.S.C. 154(b) by 65 days.

This patent is subject to a terminal disclaimer.

(21) Appl. No.: 10/564,667

(22) PCT Filed: Nov. 9, 2004

(86) PCT No.: PCT/EP2004/052876

§ 371 (c)(1),
(2), (4) Date: Jan. 13, 2006

(87) PCT Pub. No.: WO2005/061180

PCT Pub. Date: Jul. 7, 2005

(65) Prior Publication Data

US 2007/0060029 A1 Mar. 15, 2007

(30) Foreign Application Priority Data

Dec. 20, 2003 (DE) ..... 103 60 248

(51) Int. Cl.

| | |
|---|---|
| ***B24B 21/18*** | (2006.01) |
| ***B24B 33/00*** | (2006.01) |
| ***B24B 47/26*** | (2006.01) |
| ***B24B 55/00*** | (2006.01) |
| ***B24B 21/00*** | (2006.01) |
| ***B24D 15/00*** | (2006.01) |
| *B24B 27/08* | (2006.01) |

(52) U.S. Cl. ..... 451/442; 451/303; 451/508

(58) Field of Classification Search ..... 451/442, 451/393, 508, 425

See application file for complete search history.

(56) References Cited

U.S. PATENT DOCUMENTS

| | | | | | |
|---|---|---|---|---|---|
| 3,295,262 | A | * | 1/1967 | Brown | 451/344 |
| 5,346,453 | A | * | 9/1994 | Rivera-Bottzeck | 483/1 |
| 5,406,752 | A | * | 4/1995 | Neff | 451/344 |
| 6,093,090 | A | * | 7/2000 | Tosto et al. | 451/342 |
| 6,110,028 | A | * | 8/2000 | Chung | 451/359 |

(Continued)

FOREIGN PATENT DOCUMENTS

| | | |
|---|---|---|
| DE | 102 18 196 | 11/2003 |

(Continued)

*Primary Examiner*—Joseph J Hail, III
*Assistant Examiner*—Alvin J Grant
(74) *Attorney, Agent, or Firm*—Michael J. Striker

(57) ABSTRACT

An insertion tool (12) for an angle grinder (2) that has a hub (16) with at least a first fastening means for fastening the hub (16) to a driving device (22) of the angle grinder (2). The first fastening means if located on a partial circle (54) with a radius (56) of between 12 mm and 25 mm.

33 Claims, 4 Drawing Sheets

U.S. PATENT DOCUMENTS

| | | | | |
|---|---|---|---|---|
| 6,309,288 | B1 * | 10/2001 | Chung | 451/359 |
| 6,786,811 | B2 * | 9/2004 | Krondorfer et al. | 451/342 |
| 6,813,837 | B1 * | 11/2004 | Chen | 30/272.1 |
| 6,905,401 | B1 * | 6/2005 | Chen | 451/342 |
| 6,942,560 | B2 * | 9/2005 | Hofmann et al. | 451/359 |
| 7,029,385 | B1 * | 4/2006 | Wang | 451/359 |
| 7,094,139 | B2 * | 8/2006 | Marohl et al. | 451/442 |
| 2002/0115394 | A1 * | 8/2002 | Krondorfer et al. | 451/342 |
| 2003/0104773 | A1 | 6/2003 | Krondorfer et al. | |
| 2004/0012160 | A1 * | 1/2004 | Krondorfer et al. | 279/9.1 |
| 2004/0248505 | A1 * | 12/2004 | Chen | 451/340 |

FOREIGN PATENT DOCUMENTS

| | | |
|---|---|---|
| WO | 03/002304 | 1/2003 |
| WO | 03/011527 | 2/2003 |
| WO | 03/097299 | 11/2003 |
| WO | 03/103900 | 12/2003 |

* cited by examiner

INSERTION TOOL FOR AN ANGLE GRINDER

CROSS-REFERENCE TO A RELATED APPLICATION

The invention described and claimed hereinbelow is also described in German Patent Application DE 103602248.8 filed on Dec. 20, 2003. This German Patent Application, whose subject matter is incorporated here by reference, provides the basis for a claim of priority of invention under 35 U.S.C. 119(a)-(d).

BACKGROUND INFORMATION

The present invention is directed to an insertion tool for an angle grinder. The present invention is also directed to a system composed of an insertion tool with a hub and a driving device for an angle grinder.

Publication WO 03/097299 makes known an insertion tool—which represents the general class—for an angle grinder that includes a hub with a plurality of fastening means in the form of recesses. The insertion tool can be advantageously clamped onto a driving device of the angle grinder using a keyless system, which is also known from the publication cited above.

SUMMARY OF THE INVENTION

The present invention is directed to an insertion tool for an angle grinder that has a hub with at least one fastening means for fastening the hub to a driving flange of the angle grinder.

The present invention is also directed to a system composed of an insertion tool with a hub and a driving device for an angle grinder, the hub including at least a first fastening means, and the driving device including at least a first fastening element for interacting with the first fastening means and for fastening the hub to the driving device.

It is provided that the first fastening means is located on a partial circle with a radius between 12 mm and 25 mm.

Due to the proposed dimension of the partial circle, an insertion tool can be obtained that is reliably and easily installable on an angle grinder, using a keyless system in particular. An insertion tool that is advantageously well-designed and matched to the driving flange can be obtained, and advantageous force distributions in the insertion tool and into the driving flange while working with the insertion tool can be achieved.

The means of achieving the object according to the present invention can be used with all insertion tools for angle grinders that appear suitable to one skilled in the art, such as rubber backing pads, cutting discs, rough grinding discs, grinding discs, etc. The hub can be made of a material out of which the abrasive body is made, or out of another material, such as sheet steel.

Further advantages result from the description of the drawing, below. An exemplary embodiment of the present invention is shown in the drawing. The description of the drawing contains numerous independent features, each of which independently improves the means of achieving the object according to the present invention. The means of achieving the object according to the present invention can be improved by one or more of these features without the need to add additional features from the description of the drawing.

DESCRIPTION OF THE PREFERRED EMBODIMENTS

Figure 1:
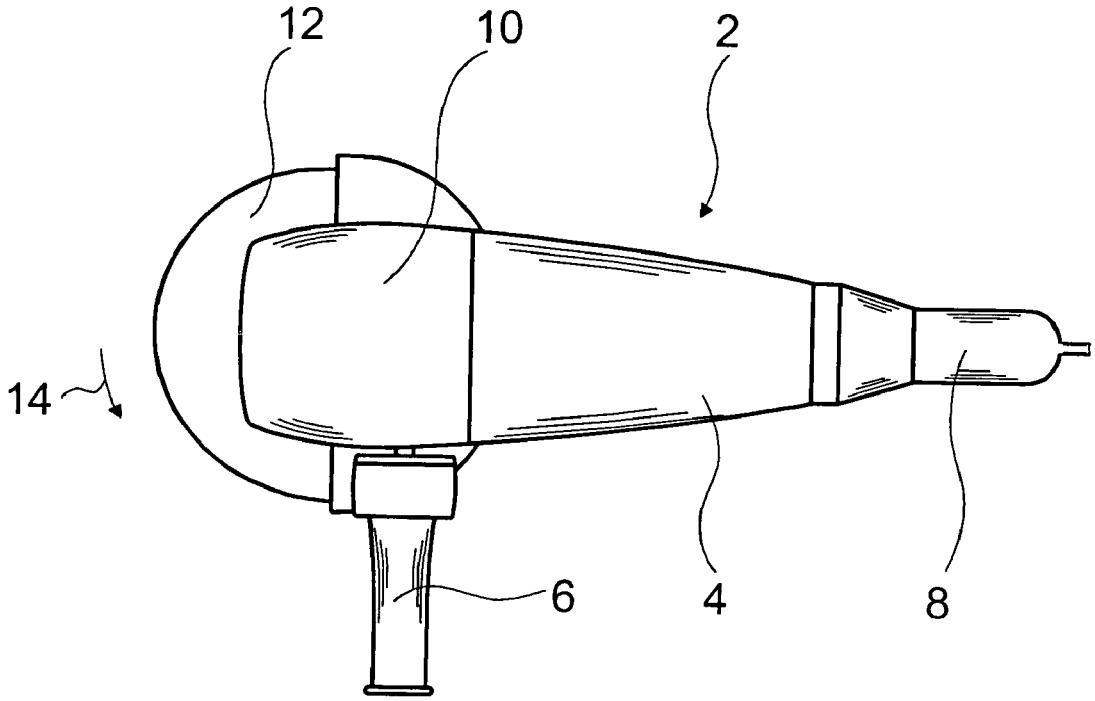
FIG. 1 Shows an angle grinder with a cutting disc.

FIG. 1 shows an angle grinder 2 from above with an electric motor (not shown) supported in a housing 4. Angle grinder 2 is guidable using two handles 6, 8. An insertion tool 12 is drivable in direction of rotation 14 via the electric motor, a not-shown transmission in a transmission housing 10, and a drive shaft (not shown).

When angle grinder 2 is viewed not from the top, as in FIG. 1, but from the bottom, a hub 16 of insertion tool 12 can be seen. This hub is shown in a perspective view in FIG. 2. An abrasive body 18, shown in FIG. 1, of insertion tool 12 is located around hub 16, abrasive body being fastened to hub 16 with the aid of fastening means 20. Fastening means 20 are located in a radially outer region of hub 16 on a second partial circle, the entirety of which extends in the region of hub material. There are therefore no recesses located between fastening means 20, thereby allowing a stable outer region of hub 16 to be obtained.

Figure 3:
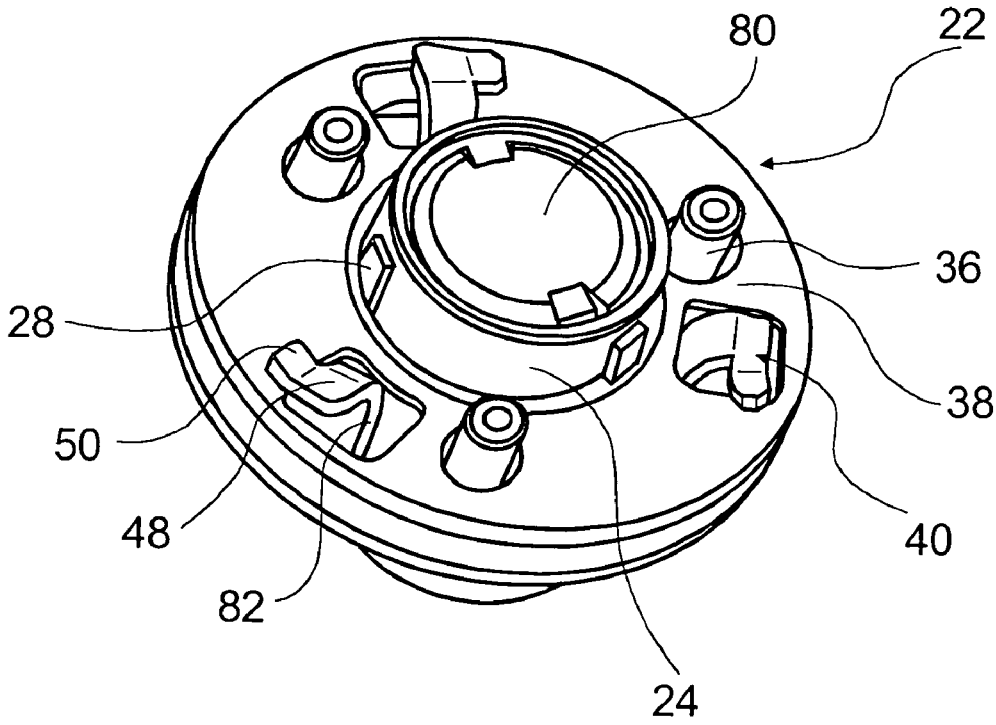
FIG. 3 Shows a driving flange of the angle grinder.

Hub 16 of insertion tool 12 configured as a rough grinding disc is designed to be inserted on a driving device 22 of angle grinder 2, which is shown in FIG. 3. Driving device 22 surrounds a centering collar 24, onto which hub 16 with a centering opening 26 can be slid. After insertion, hub 16 rests with its radially innermost part on three encoding raised areas 28 that extend radially outwardly away from centering collar 24. When resting on encoding raised areas 28, hub 16 can be rotated in tangential direction 30 until three radial recesses 32 are aligned with three encoding raised areas 28. In this position, hub 16, and with it, entire insertion tool 12, drops down slightly until it comes to rest with its inner plate 34 on three snap-in bolts 36.

These three snap-in bolts 36 are spring-loaded and can be pressed downward by an operator of angle grinder 2 by pressing on insertion tool 12. Hub 16 can now be pressed with its lower plate 34 until it reaches a base 38 of driving flange 22. As a result, fastening elements 40 configured as hooks pass through openings 42 in lower plate 34 of hub 16.

To fasten insertion tool 12 onto driving flange 22, hub 16 can now be rotated in the clockwise direction, which allows a radially innermost region 44 of lower plate 34 to be guided underneath encoding raised areas 28. At the same time, a retaining region 46 adjacent to openings 42 in lower plate 34 is slid under a slanted ramp element 48 of fastening element 40, fastening element 40 being pulled slightly upward against the force of a non-shown, preloaded spring. An exact description of driving flange 22, spring-loaded snap-in bolt 36 and fastening elements 40 is provided in publication WO 03/097299 described initially.

Figure 2:
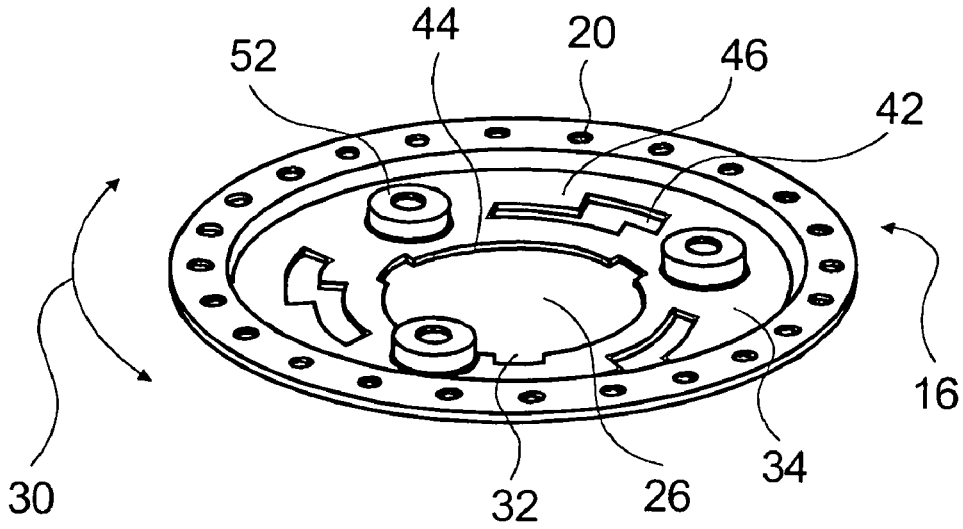
FIG. 2 Shows a hub of the cutting disc of the angle grinder.

When insertion tool 12 is rotated further in the clockwise direction, retaining region 46 is slid under a retaining element 50 oriented parallel to base 38 of driving flange 22 that presses hub 16 onto base 38 with the aid of the preloaded, not-shown spring. When a fastening position is reached, snap-in bolts 36 are aligned with pot-shaped recesses 52 in hub 16 and engage into these recesses 52 by snapping upward. Recesses 52 are designed as deformations of lower plate 34; they are shown in FIG. 2 as cylindrical raised areas. Hub 16 and, with it, entire insertion tool 12, is now fixed in tangential direction 30 by snap-in bolts 36 in pot-shaped recesses 52, and are retained in the axial direction by spring-loaded retaining elements 50.

Figure 4:
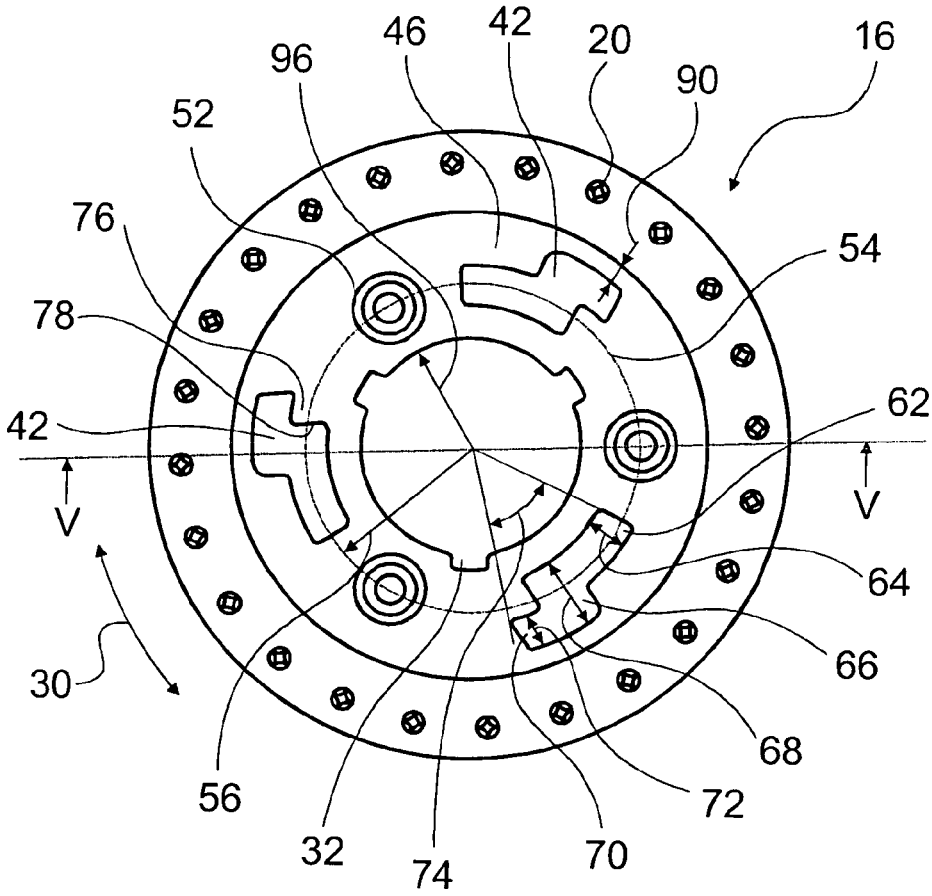
FIG. 4 Shows a top view of the hub in FIG. 2.
Figure 5:
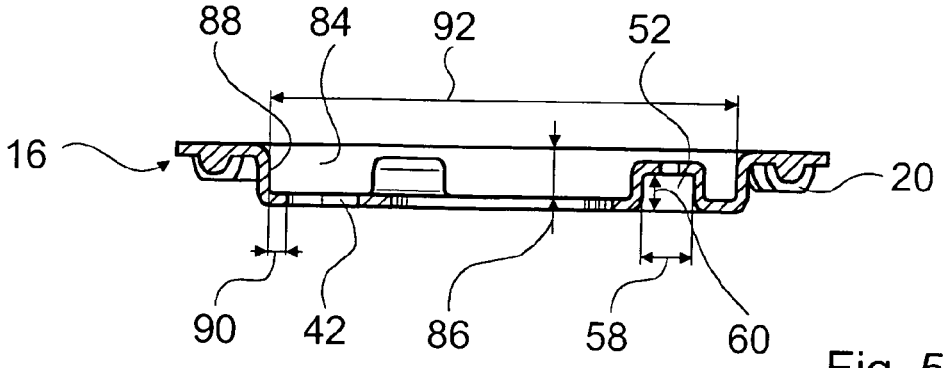
FIG. 5 Shows a sectional illustration of the hub in FIG. 2.

FIG. 4 shows a top view of hub 16 of insertion tool 12. Hub 16 includes three identical first fastening means configured as pot-shaped recesses 52 that extend out of the plane of the drawing, as seen from above. Pot-shaped recesses 52 include a circular cross section, the center point of which is located on a partial circle 54 with a radius 56 of 16.7 mm. Pot-shaped recesses 52 have a circular cross section with an inner diameter 58 of 6 mm (FIG. 5) and an inner depth 60 of 3.85 mm.

Hub 16 also includes three identically configured openings 42 as the second fastening means. These second fastening means are configured in the shape of two parallel slots oriented in tangential direction 30. The slots are substantially right-angled and abut each other along part of one of their long sides. Openings 42 include a first retaining region 62 formed by the radially inward slot with a radial width 64 of 3.9 mm. In a releasing region 66 formed by the two slots, opening 42 has a radial width 68 of 7.1 mm. In a third region 70 which also belongs to retaining region 66, radial width 72 of opening 42 is 3.4 mm. In the circumferential direction 30, each of the three openings 42 extends across an angular range 74 of approximately 60°. Openings 42 also include blocking elements 76 designed as bulges, each of which abuts the radially inner slot and extends into releasing region 66. Blocking elements 76, in turn, include a stop 78 provided to limit a releasing motion of fastening element 40 in opening 42.

Due to the fact that openings 42 are formed by two right-angled slots, a particularly stable retention of hub 16 on driving device 22 in the axial direction can be achieved using fastening elements 40 that are simple and economical to produce. In addition, with the dimensions indicated, a laterally-reversed installation of insertion tool 12 onto an identical driving flange without encoding raised areas 28 can be effectively prevented, since fastening element 40 cannot be inserted through a laterally-reversed opening 42 if it has the dimensions indicated below.

Figure 6:
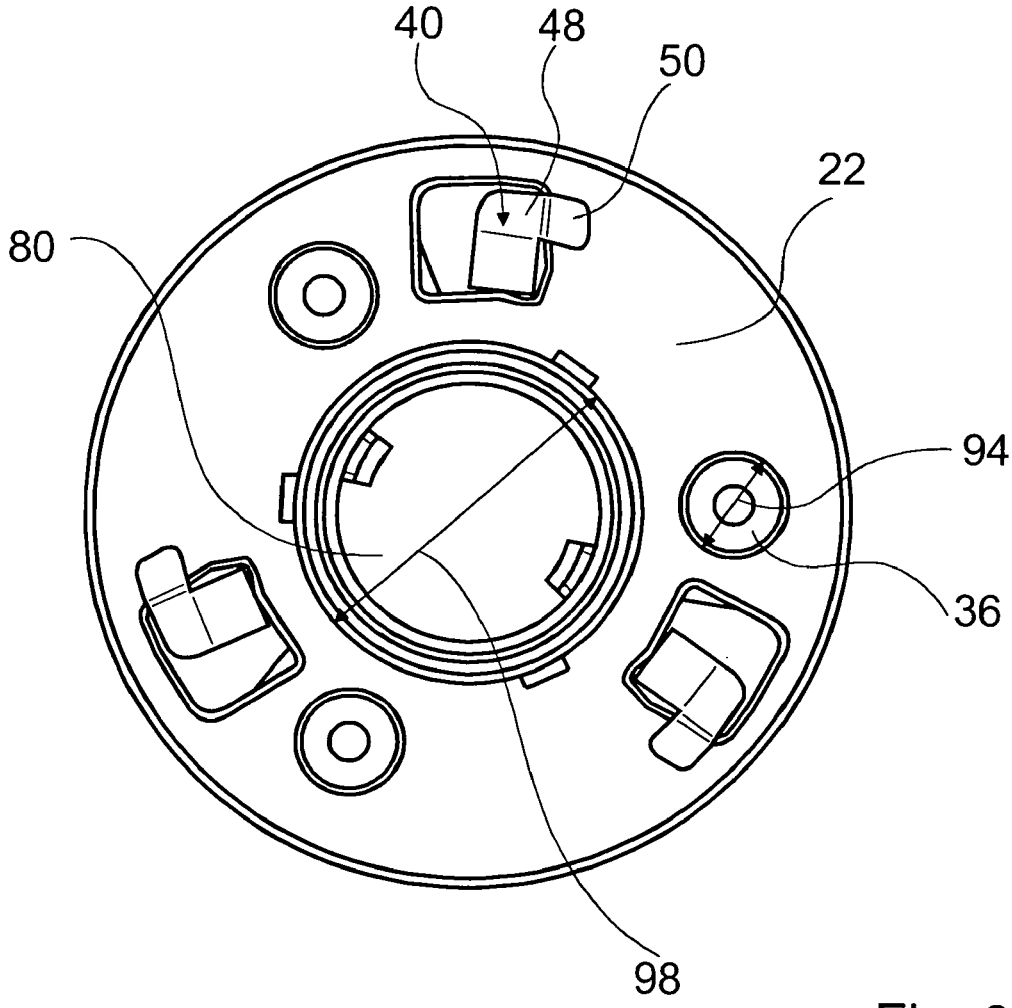
FIG. 6 Shows a top view of the driving flange in FIG. 2.

To release hub 16 from driving device 22 shown in FIG. 6 in a top view, an actuating button 80 is pressed, by way of which snap-in bolts 36 are pressed downward and out of recesses 52. Hub 16 is now rotatable in the counterclockwise direction, by way of which fastening elements 40 move in a release motion in tangential direction 30 away from retaining regions 62 toward releasing regions 66 of openings 42. The release motion can be carried out by an operator of angle grinder 2 until a segment 82 of fastening element 40 hits stop 78 of opening 42 and/or blocking element 76. The dimensions of opening 42 and its position relative to recesses 32 are designed such that, when segment 82 hits stop 78, recesses 32 are flush with encoding raised areas 28. In this position, hub 16 can be lifted off of driving device 22. Due to the shape and dimensions of opening 42 with blocking element 76 and third region 70, fastening element 40 can have retaining element 50 that extends further in the release direction than segment 82 of fastening element 40. This enables a particularly simple and economical manufacture of a stable fastening element 40 and a stable retention of hub 16 on driving device 22.

In its radially inward region, hub 16 is designed with a well-shaped recess 84 with a well depth 86 of approximately 6 mm and an inner diameter 92 of 47 mm. An inner well wall 88 is thereby formed, with openings 42 being located at minimum distance 90 of approximately 2 mm from inner well wall 88. As a result of this relatively radially far outward positioning of openings 42 in hub 16, a stable axial fixing of hub 16 on driving device 22 via retaining elements 50 can be obtained.

When snap-in bolts 36 designed as fastening elements engage in recesses 52, snap-in bolts 36—which have an outer diameter 94 of 5.5 mm—are located in recesses 52 with a play of 0.5 mm. This relatively large amount of play makes it possible for snap-in bolts 36 to also engage in recesses 52 when snap-in bolts 36 or recesses 52 are very dirty. As a result, a secure fixing of insertion tool 12 in tangential direction 30 can be ensured, even when insertion tool 12 is very dirty.

Due to the large amount of play—which serves to provide operational reliability—between snap-in bolts 36 and recesses 52, hub 16 cannot be retained in a centered position on driving device 22 by snap-in bolts 36. Centering of this type, which is necessary, is achieved by the dimensions of centering opening 26 and centering collar 24, the play of which relative to each other is less—by a factor of approximately 17—than the play between snap-in bolts 36 and recesses 52. Inner radius 96 of centering collar 26 is 11.1 mm, while the outer radius 98 of centering collar 24 is 11.115 mm. Since centering collar 24 and centering opening 26 are circular in design, the play between centering collar 24 and centering opening 26 is 0.03 mm.

Due to the relatively large amount of play between snap-in bolts 36 and recesses 52, the contact surface between snap-in bolts 36 and recesses 52 attainable via elastic deformation can be very small during operation of insertion tool 12. So that the resultant wear of snap-in bolts 36 remains minimal, snap-in bolts 36 are made of a hardened steel, while recesses 52 in hub 16 are made of an unhardened metal, e.g., unhardened steel sheet. During operation of insertion tool 12, snap-in bolts 36 can extend into recesses 52 and deform them slightly, so that a sufficiently large contact surface between snap-in bolts 36 and recess 52 results, which results in low wear of snap-in bolts 36 even when insertion tool 12 undergoes strong vibration.

What is claimed is:

1. An insertion tool (12) for an angle grinder (2) that has a hub (16) with at least a first fastening means for fastening the hub (16) to a driving device (22) of the angle grinder (2), wherein the first fastening means is located on a partial circle (54) with a radius (56) dimensioned to provide reliable and easy installation of the insertion tool on the angle grinder using a keyless system that enables handy use with sufficient working material and equal to between 12 mm and 25 mm, wherein the hub (16) includes a second fastening means, wherein said second fastening means is formed by two slots that abut each other along part of their long sides, wherein the second fastening means is configured as an opening (42);

wherein the opening (42) includes a retaining region (62), a releasing region (66) and a third region (70);

wherein said opening (42) includes a blocking element (76) which is designed as a bulge and abuts a radially inner slot and extends into the releasing region (66);

wherein said blocking element (76) includes a stop (78) provided to limit a releasing motion of the insertion tool (12); and wherein the third region (70) is embodied as a recess which facilitates the releasing of the insertion tool (12).

2. The insertion tool (12) as recited in claim 1, wherein the first fastening means has a circular cross section with a center point on a partial circle (54) with a radius (56) of 16.5 mm to 17.0 mm.

3. The insertion tool (12) as recited in claim 1, wherein the first fastening means is configured as a pot-shaped recess (52) with an inner diameter (58) of 5.7 mm to 6.5 mm.

4. The insertion tool (12) as recited in claim 1, wherein the first fastening means is configured as a pot-shaped recess (52) with an inner depth (60) over 3.5 mm to 4.5 mm.

5. The insertion tool (12) as recited in claim 1, characterized by a second fastening means with a retaining region (62) formed by a first slot with a width of 3.5 mm to 4.5 mm, and a releasing region (66) with a width of 6.5 mm to 7.5 mm.

6. The insertion tool (12) as recited in claim 5, wherein the second fastening means has a region (70) formed by a second slot having a width of 2.5 mm to 4.5 mm.

7. The insertion tool (12) as recited in claim 5, wherein the second fastening means extends in the circumferential direction (30) across an angular range (74) of 55° to 65°.

8. The insertion tool (12) as recited in claim 5, wherein the second fastening means is located in a well-shaped region with an inner well wall (88), and the second fastening means is located less than 3 mm from the inner well wall (88).

9. The insertion tool (12) as recited in claim 1, wherein at least three third fastening means (20), located on a second partial circle, for fastening an abrasive body (18) to the hub (16) extends, in entirety, outside the third fastening means (20) in the region of hub material.

10. The insertion tool (12) as recited in claim 1, wherein the second fastening means is configured in the shape of two parallel slots oriented in a tangential direction (30).

11. The insertion tool (12) as recited in claim 1, wherein the second fastening means is configured as an opening (42) which includes a first retaining region (62) formed by a radially inner slot with a radial width (64) of 3.9 mm.

12. The insertion tool (12) as recited in claim 1, wherein the second fastening means is configured as an opening (42) which includes a blocking element (76) designed as a bulge.

13. The insertion tool (12) as recited in claim 12, wherein the blocking element (76) abuts the radially inner slot and extends into a releasing region (66).

14. The insertion tool (12) as recited in claim 12, wherein the blocking element (76) includes a stop (78) configured for limiting a releasing motion of a fastening element (40) in the opening (42).

15. The insertion tool as recited in claim 11, wherein a contour of the opening is formed step-like respectively at opposite sides of the opening.

16. The insertion tool as recited in claim 11, wherein a first long slot is composed of a radially inner long slot and a second long slot is composed of a radially outer long slot, wherein the opening includes a retaining region, a releasing region and a third region, wherein the retaining region is formed by the radially inward inner long slot, the releasing region is formed by the two long slots and the third region is a part of the releasing region.

17. The insertion tool as recited in claim 16, wherein the retaining region extends in a circumferential direction over a greater angular range than the third region.

18. The insertion tool as recited in claim 16, wherein the releasing region extends radially over the two long slots.

19. The insertion tool as recited in claim 16, wherein the retaining region forms in a radial direction an insert region of the opening and the third region forms in the radial direction an outward region of the opening.

20. The insertion tool as recited in claim 16, wherein the retaining region and the third region respectively have a radial width that is smaller than a radial width of the releasing region.

21. The insertion tool as recited in claim 1, wherein the long slots are constructed to be right-angled.

22. The insertion tool as recited in claim 1, wherein the two long slots arranged displaced to each other in a tangential direction.

23. The insertion tool as recited in claim 1 wherein a first long slot is composed of a radially inner long slot and a second long slot is composed of a radially outward long slot.

24. The insertion tool as recited in claim 23, wherein the radially inward long slot in a circumferential direction is longer than the radially outward long slot.

25. A system composed of an insertion tool (12) with a hub (16) and a driving device (22) for an angle grinder (2), the hub (16) having at least a first fastening means, and the driving device (22) having at least a first fastening element for interacting with the first fastening means of the hub and for fastening the hub (16) to the driving device (22), wherein the first fastening means of the hub is located on a partial circle (54) with a radius (56) dimensioned to provide reliable and easy installation of the insertion tool on the angle grinder using a keyless system that enables handy use with sufficient working material and equal to between 12 mm and 25 mm, wherein the hub (16) includes a second fastening means, wherein said second fastening means of the hub is formed by two slots that abut each other along part of their long sides, the driving device (22) includes a fastening means (40), wherein said fastening means (40) of the driving device (22) is configured as a hook with a retaining element (50);

wherein the second fastening means of the hub (16) is configured as an opening (42);

wherein the opening (42) includes a retaining region (62), a releasing region (66) and a third region (70);

wherein said opening (42)includes a blocking element (76) which is designed as a bulge and abuts a radially inner slot and extends into the releasing region (66), wherein said blocking element (76) includes a stop (78) provided to limit a releasing motion of said fastening means (40) of the driving device (22), and wherein the third region (70) is embodied as a recess which facilitates the releasing of said retaining element (50) of said fastening means (40) of the driving device (22) during a releasing process of the insertion tool (12) from the driving device (22).

26. The system as recited in claim 25, wherein the first fastening means has a pot-shaped recess (52) with an inner diameter (58) of 5.7 mm to 6.5 mm, and the first fastening element has a bolt shape with an outer diameter (94) that is more than 0.3 mm smaller than the inner diameter (58).

27. The system as recited in claim 25, wherein the hub (16) includes a centering opening (26) capable of being inserted on a centering collar (24) of the driving device (22), the play between the centering opening (26) and centering collar (24) being less than the play between the fastening means and fastening element by a factor of at least 5, preferably at least by a factor of 10.

28. The system as recited in claim 27, wherein the centering opening (26) has an inner radius (96) that is smaller than an outer radius (98) of the centering collar (24) by a maximum of 0.1 mm.

29. The system as recited in claim 25, wherein the first fastening element is made of a hardened steel, and the hub (16) is made of an unhardened metal in the region of the first fastening means.

30. The system as recited in claim 25, wherein the hub (16) is insertable on the driving device (22) and includes at least a second fastening means through which a second fastening element (40) of the driving device (22) is guidable, the second fastening means including a blocking element (76) that prevents the second fastening element (40) from being inserted when the hub (16) has been installed in a laterally-reversed manner.

31. The insertion tool as recited in claim 30, wherein a first long slot is composed of a radially inner long slot and a second long slot is composed of a radially outer long slot and the radially inward long slot includes the blocking element.

32. An insertion tool for an angle grinder that has a hub with at least a first fastening means for fastening the hub to a driving device of the angle grinder, wherein the first fastening means is located on a partial circle with a radius dimensioned to provide reliable and easy installation of the insertion tool on the angle grinder using a keyless system, wherein said radius is between 12 mm and 25 mm, wherein said hub includes a second fastening means, wherein said second fastening means is formed by two right-angled long slots that abut each other along a part of respective long sides, wherein the two right-angled long slots are arranged displaced along a circumferential direction to each other, wherein the second fastening means is configured as an opening, and wherein a contour of the opening is formed step-like, respectively, at opposite sides of the opening.

33. An insertion tool for an angle grinder that has a hub with at least a first fastening means for fastening the hub to a driving device of the angle grinder, wherein the first fastening means is located on a partial circle with a radius dimensioned to provide reliable and easy installation of the insertion tool on the angle grinder using a keyless system, wherein said radius is between 12 mm and 25 mm, wherein the hub includes a second fastening means, wherein said second fastening means is formed by two long slots that abut each other along part of respective long sides, wherein the second fastening means is configured as an opening, wherein the opening includes a retaining region, a releasing region, and a third region, wherein a first long slot is composed of a radially inner long slot and a second long slot is composed of a radially outer long slot, wherein the retaining region is formed by the radially inner long slot and the releasing region is formed by the two long slots, wherein the releasing region of a radially outer long slot which also belongs to the releasing region includes the third region, wherein the hub is insertable on the driving device and includes at least a second fastening means through which a second fastening element of the driving device is guidable, wherein the second fastening means includes a blocking element that prevents the second fastening element from being inserted when the hub has been installed in a laterally-reversed manner, wherein the radially inward long slot includes a blocking element and forms the retaining region, wherein the third region forms an outer region of the opening in a radial direction, and wherein the retaining region and the third region offer a radial width that is smaller than a radial width of the releasing region.

* * * * *